US011118769B1

(12) United States Patent
Sheehy et al.

(10) Patent No.: US 11,118,769 B1
(45) Date of Patent: Sep. 14, 2021

(54) ROTATING AND TILTING LIGHTING FIXTURES

(71) Applicant: ABL IP Holding LLC, Atlanta, GA (US)

(72) Inventors: James Sheehy, Riverside, IL (US); Douglas Dewayne Grove, Grayson, GA (US); Bruce Layne, Wheaton, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/796,206

(22) Filed: Feb. 20, 2020

(51) Int. Cl.

| | |
|---|---|
| ***F21V 21/02*** | (2006.01) |
| ***F21V 21/28*** | (2006.01) |
| ***F21V 23/00*** | (2015.01) |
| ***F21S 8/00*** | (2006.01) |

(52) U.S. Cl.
CPC ..... *F21V 21/28* (2013.01); *F21S 8/036* (2013.01); *F21V 23/002* (2013.01)

(58) Field of Classification Search
CPC ..... F21V 21/28; F21V 23/002; F21S 8/036
See application file for complete search history.

(56) References Cited

U.S. PATENT DOCUMENTS

| | | | |
|---|---|---|---|
| 6,123,438 | A | 9/2000 | Hentz |
| 6,226,939 | B1 | 5/2001 | Atkins et al. |
| 6,872,885 | B1 | 3/2005 | Newbold, Jr. |
| 7,114,294 | B2 | 10/2006 | Newbold et al. |
| 7,427,147 | B2 | 9/2008 | Kovacs |
| 7,470,048 | B2 | 12/2008 | Wu |
| 7,476,010 | B2 | 1/2009 | Johnson |
| 7,503,145 | B2 | 3/2009 | Newbold et al. |
| 7,627,999 | B2 | 12/2009 | Latanision |
| 7,651,238 | B2 | 1/2010 | O'Brien |
| 7,651,248 | B2 | 1/2010 | Hua |
| 7,670,033 | B2 | 3/2010 | Steer et al. |
| 7,841,135 | B2 | 11/2010 | Newbold et al. |
| 7,954,974 | B2 | 6/2011 | Johnson |
| 8,333,490 | B2 | 12/2012 | Wu |
| 8,517,568 | B2 | 8/2013 | Wu |
| 8,629,348 | B2 | 1/2014 | Moselle |
| 8,657,473 | B2 | 2/2014 | Esmailzadeh |
| 9,335,032 | B2 | 5/2016 | Holder et al. |
| 9,709,257 | B2 | 7/2017 | Wu |
| 9,784,443 | B2 | 10/2017 | Rashidi Doust |
| 9,797,563 | B2 | 10/2017 | Luo et al. |
| 9,803,845 | B2 | 10/2017 | Luo et al. |
| 9,890,944 | B2 | 2/2018 | Chou |

(Continued)

*Primary Examiner* — Karabi Guharay
(74) *Attorney, Agent, or Firm* — Kilpatrick Townsend & Stockton LLP

(57) ABSTRACT

A wall-mounted lighting fixture includes a mounting plate, a canopy and an aiming assembly. The canopy is secured to a mounting plate mounted to a wall. The aiming assembly includes a disk, a tilting assembly, and a light emitting assembly. The canopy defines a circular recess which the disk is positioned flush within. The tilting assembly is coupled to the disk and the light emitting assembly, and includes a pivot joint, for example a hinge, allowing the light emitting assembly to tilt relative to the disk. The disk is rotatably coupled to the canopy allowing the light emitting assembly to rotate relative to the canopy, and therefore the wall. The tilting and rotation allow emitted light from the light emitting assembly to be aimed in two degrees of freedom.

19 Claims, 13 Drawing Sheets

(56) References Cited

U.S. PATENT DOCUMENTS

| | | | | |
|---|---|---|---|---|
| 2006/0109612 | A1 | 5/2006 | Kovacs | |
| 2006/0109660 | A1 | 5/2006 | Wolf et al. | |
| 2008/0010907 | A1 | 1/2008 | Moench | |
| 2009/0040774 | A1* | 2/2009 | Avila | F21V 21/28 362/371 |
| 2009/0050338 | A1 | 2/2009 | Kovacs | |
| 2010/0014282 | A1 | 1/2010 | Danesh | |
| 2011/0299280 | A1 | 12/2011 | Maeers | |
| 2014/0102733 | A1 | 4/2014 | Moselle | |
| 2016/0209018 | A1 | 7/2016 | Johnson | |
| 2017/0138576 | A1 | 5/2017 | Peng et al. | |
| 2017/0248298 | A1 | 8/2017 | Wu | |
| 2017/0350582 | A1 | 12/2017 | Benghozi et al. | |
| 2018/0119905 | A1 | 5/2018 | Luo et al. | |
| 2019/0234593 | A1* | 8/2019 | Stevens | H01R 13/73 |

* cited by examiner

ROTATING AND TILTING LIGHTING FIXTURES

FIELD OF INVENTION

The present technology relates to the field of wall-mounted lighting fixtures, and more particularly to a method and apparatus for installing a wall-mounted lighting fixture.

BACKGROUND OF THE INVENTION

Wall-mounted lighting fixtures are used in residential and commercial locations and may be used for various illumination purposes, including wall wash illumination, accent lighting of a specific object, and general ambient illumination. Further, wall-mounted lighting fixtures are often desirable because they do not take up valuable floor space, as compared for example with floor lamps.

SUMMARY OF THE INVENTION

A wall-mounted lighting fixture includes a mounting plate, a canopy and an aiming assembly. The canopy is secured to a mounting plate mounted to a wall. The aiming assembly includes a disk, a tilting assembly, and a light emitting assembly. The canopy defines a circular recess which the disk is positioned flush within. The tilting assembly is coupled to the disk and the light emitting assembly, and includes a pivot joint, for example a hinge, allowing the light emitting assembly to tilt relative to the disk. The disk is rotatably coupled to the canopy allowing the light emitting assembly to rotate relative to the canopy, and therefore the wall. The tilting and rotation allow emitted light from the light emitting assembly to be aimed in two rotational degrees of freedom.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

Figure 1A:
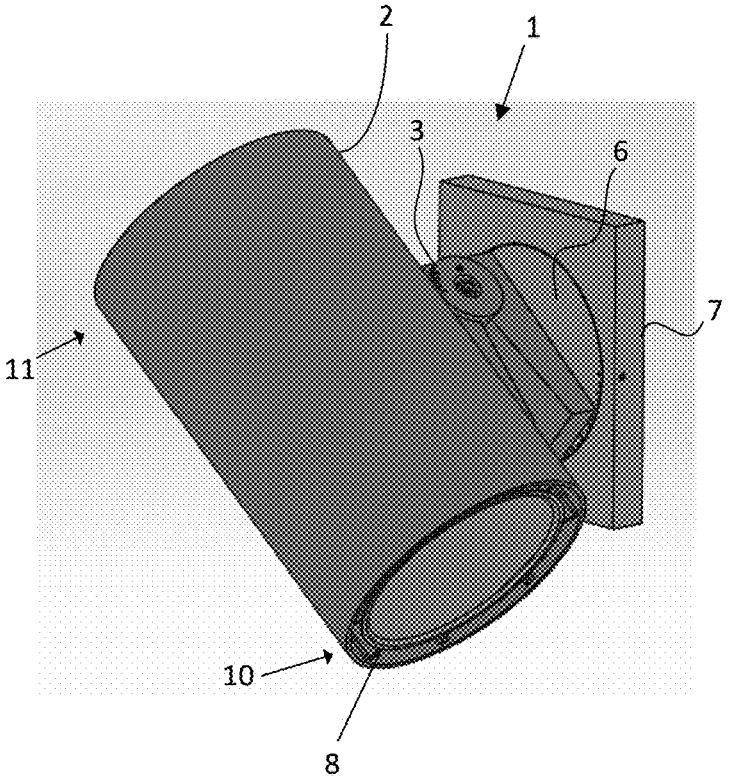
FIGS. 1A-1C show views of a wall-mounted lighting fixture in accordance with embodiments of the disclosed technology.
Figure 1B:
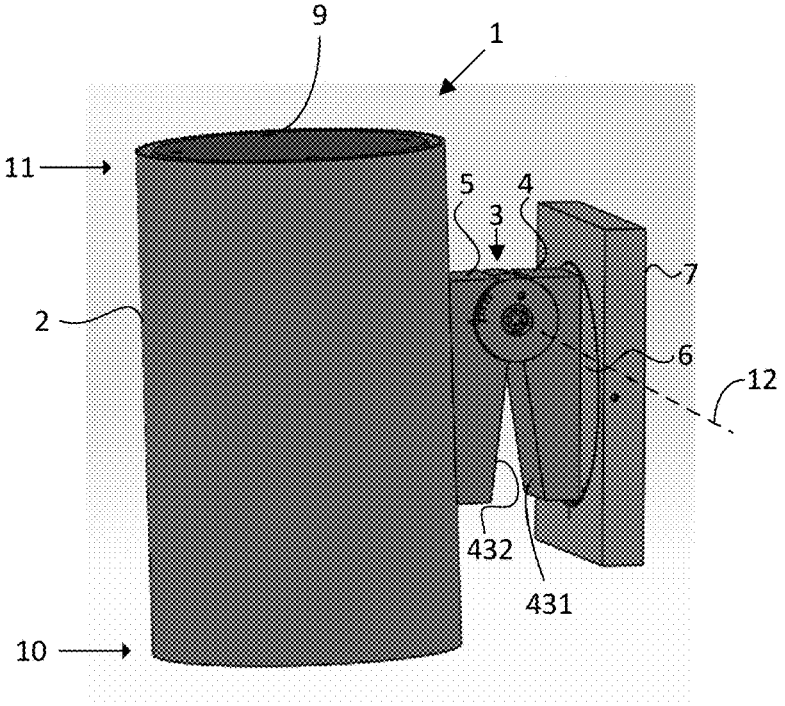
Figure 1C:
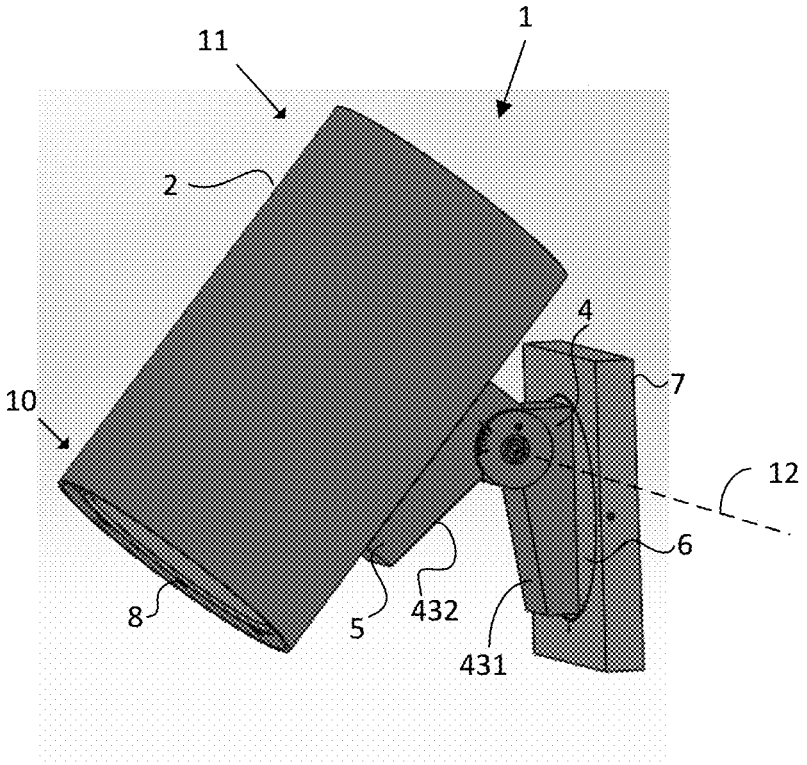
Figure 5A:
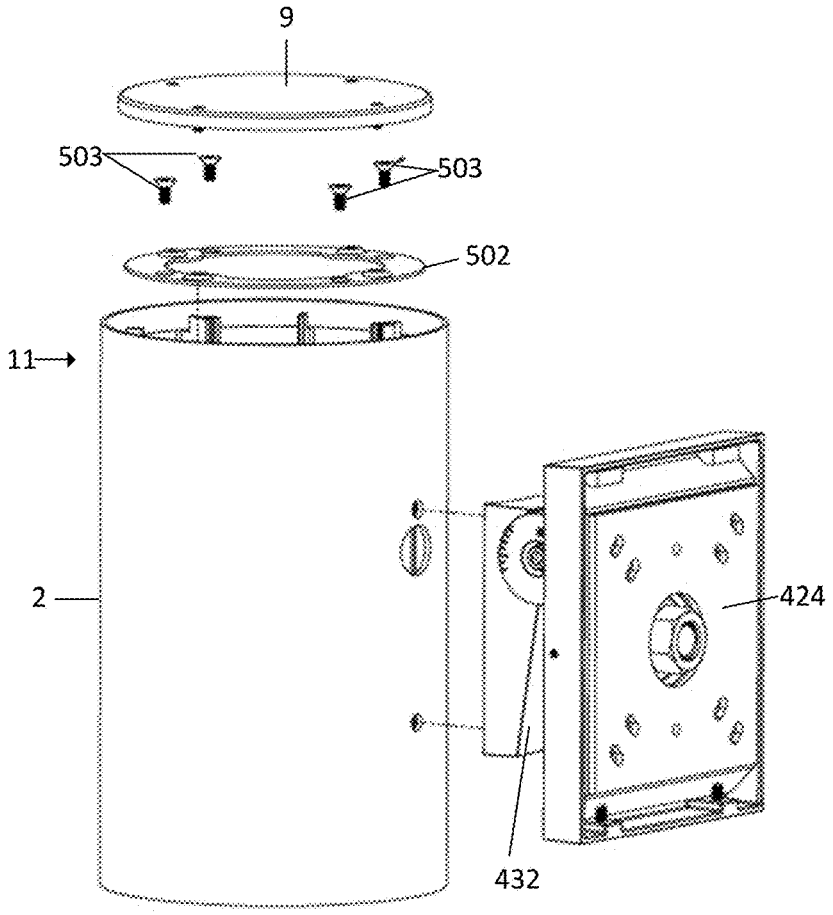
FIGS. 5A and 5B show views of assembling an wall-mounted lighting fixture in accordance with embodiments of the disclosed technology.
Figure 5B:
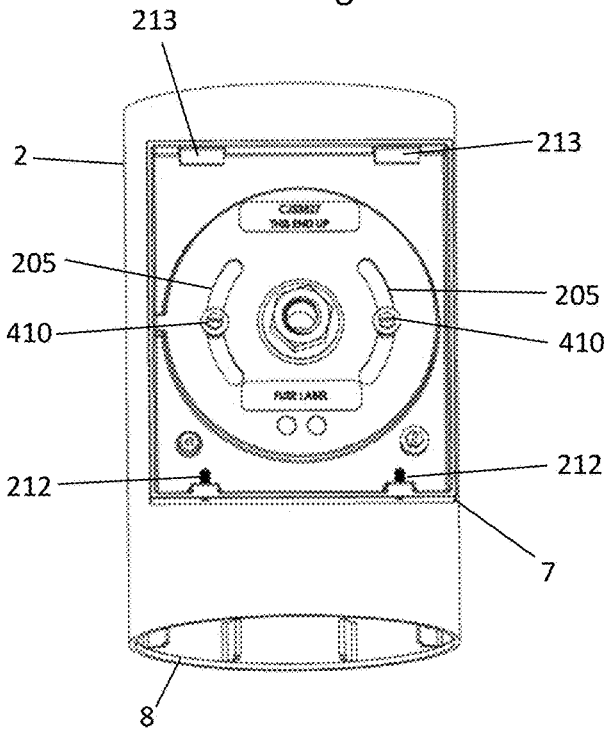

FIGS. 1A-1C show an embodiment of a wall-mounted lighting fixture 1. As shown in the perspective view of FIG. 1A, the lighting fixture 1 comprises a housing 2, a pivot arm assembly 3 coupled to the housing 2, a disk 6 coupled to the pivot arm assembly 3, and a canopy 7 rotatably coupled to disk 6. The housing 2 houses one or more light sources (not shown), such as but not limited to light emitting diodes, halogen bulbs, incandescent bulbs, etc. The housing 2 defines an aperture 8 at a first end 10 that permits light generated by the light sources to exit the housing 2. An optic (not shown) may also be provided in the housing 2 (such as proximate to aperture 8) to direct and/or control light emission from the housing 2. In the illustrated embodiment, an end cap 9 is positioned on an opposing second end 11 of the housing 2 to block light emission from the second end 11. As shown in FIG. 5A, a gasket 502 may be secured between the second end 11 of the housing 2 and the end cap 9 with fasteners 503 to seal the housing 2 and protect its contents from dirt, dust, and environmental elements. The end cap 9 may be provided as a separate component or, alternatively, may be formed integrally with the housing 2. In other embodiments, the second end 11 of the housing 2 also defines an aperture to permit simultaneous up-lighting and down-lighting from the lighting fixture 1 when installed. The housing 2 may house other types of components such as a lightbulb socket (e.g. an Edison screw, bi-post, or bayonet style connector), a power supply, sensors, a wired or wireless controller, or other components of combinations of components. The housing 2, light emitting element, end cap 9, and any other components within the housing 2 may be referred to as a light emitting assembly. In embodiments, the housing may be cylindrically shaped, as shown for example in FIG. 1A, or may be other shaped such as a cone or a rectangular prism.

As shown in FIGS. 1B and 1C, the pivot arm assembly 3, which may also be referred to as a tilting assembly, comprises a wall-side pivot arm 4 rotatably coupled to a lighting side pivot arm 5, which may be referred to as a first pivot arm and a second pivot arm. As shown in FIGS. 1B and 1C, the pivot arm assembly 3 allows the housing 2 to be pivoted, i.e. tilted, relative to the canopy 7 about a first rotational axis 12 in order to control the direction of light emitted from the aperture 8 in a first rotational degree of freedom. The housing 2 may rotate 0° to 90° about first rotational axis 12. In some embodiments, the housing 2 can rotate more than 90° about first rotational axis, such as up to 135°. Further, as shown in FIGS. 1A and 1B, the rotatable coupling of the disk 6 to the canopy 7 allows the housing 2 to rotate about a second rotational axis 13 in order to control the direction of light emitted from the aperture 8 in a second rotational degree of freedom. The first rotational axis 12 and second rotational axis 13, and thus the first and second rotational degrees of freedom, may be orthogonal to each other, but could be oriented at other angles relative to each other. The components allowing for the two degrees of rotational freedom may be referred to as an aiming assembly.

Figure 2A:
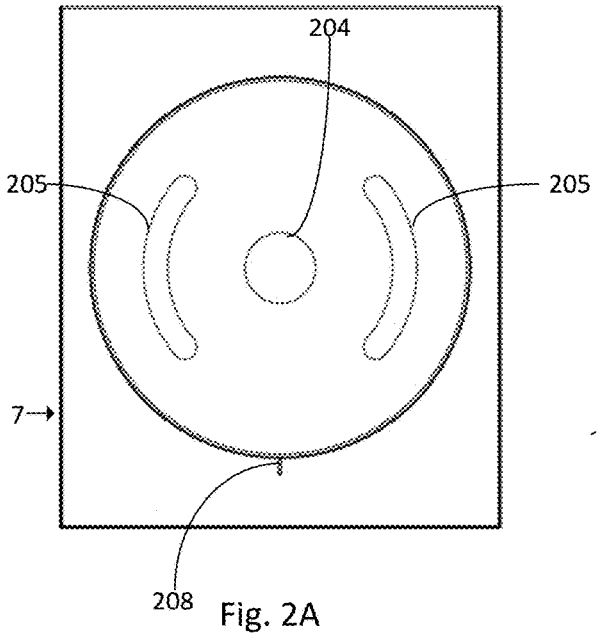
FIGS. 2A-2D show views of a canopy in accordance with embodiments of the disclosed technology.
Figure 2B:
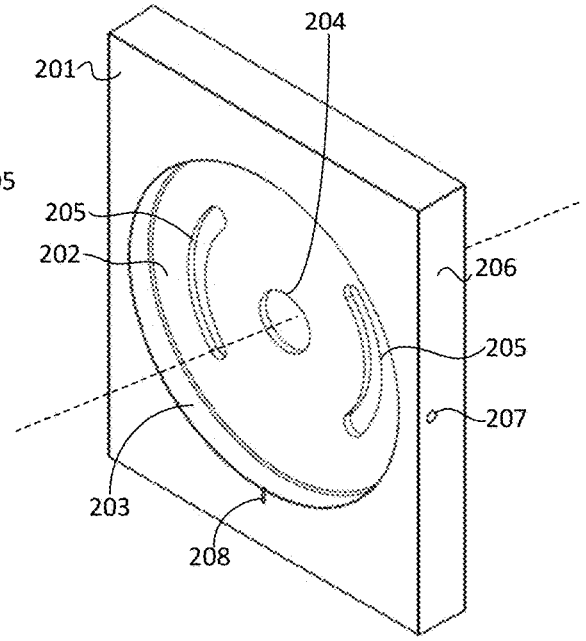

FIGS. 2A-2D show an embodiment of a canopy 7 as shown in the wall-mounted lighting fixture 1 of FIG. 1A. As shown in FIG. 2A the perimeter of the canopy 7 is generally square in shape from a front view, however in other embodiments the canopy may be other shapes including other parallelograms and/or round/circular. As shown in FIG. 2B, the canopy 7 comprises an outer surface 201. The outer surface 201 may be generally flat and in an installed configuration the outer surface 201 of the canopy 7 may extend parallel to the wall onto which the lighting fixture 1 is mounted. Recessed from the outer surface 201 is a recessed surface 202. The recessed surface 202 may be generally flat and extend parallel to the outer surface 201. Extending between the outer surface 201 and the recessed surface 202 is a recess sidewall 203. The recessed surface 202 and the recess sidewall 203 define a cylindrical recess shaped and sized to rotatably receive the disk 6.

The canopy 7 further defines a center hole 204 extending through the recessed surface 202. The center hole 204 may be circular and centered in the circular recessed surface 202. The center hole 204 receives an axle of the disk 6 and defines the second rotational axis 13. The canopy 7 further defines two rotation limiting tracks 205. The rotation limiting tracks 205 may be arc shaped, wherein both of the arcs of the rotation limiting tracks 205 are portions of a circle around the second rotational axis. The length of the rotation limiting tracks 205 controls the extent to which the disk 6 can rotate relative to the canopy 7 about the second rotational axis 13 (the degree of rotational freedom between the disk 6 and canopy 7). Limiting the degree of rotational freedom is beneficial in preventing wiring extending through the lighting fixture, for example wiring supplying power to a lighting element, from being damaged due to over twisting. In embodiments, a slip ring may be provided without rotation limiting tracks in order to allow for full 360 rotation of the disk 6 relative to the canopy 7 without the risk of wiring damage due to twisting of the wiring. In embodiments, the arc length of the rotation limiting tracks 205 is 50 degrees and 170 degrees, inclusive.

Figure 2C:
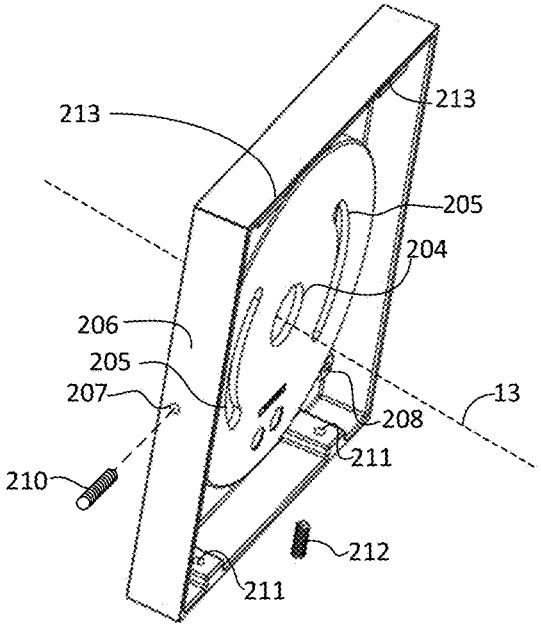

As shown in FIGS. 2B and 2C, the canopy 7 further comprises a sidewall 206. The sidewall 206 extends rearwardly from and surrounds the outer surface 201 and may extend a greater depth than the recessed surface 202. In the installed configuration, the rear edge 209 of the sidewall 206 opposite the outer surface 201 rests flush against a wall onto which the lighting fixture 1 is mounted. The canopy 7 defines a set screw hole 207 to receive a set screw 210 to fix the rotational position of the disk 6 relative to the canopy 7, as will be discussed in greater detail below. As shown in FIG. 2C, the wall facing portion of the canopy 7 includes an inner recess defined by the inner sides of the sidewall 206, recess sidewall 203, recessed surface 202, and outer surface 201. The inner recess includes a threaded stud 208 for fastening a safety cable, as will be discussed in greater detail below.

Figure 2D:
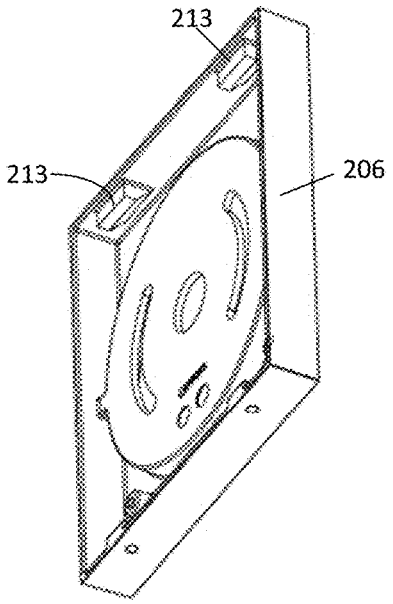

As shown in FIG. 2D, The canopy 7 further defines two mounting clips 213 along the top edge of the sidewall 206. The mounting clips 213 may be triangular prisms including a sloped surface, the sloped surfaces face obliquely toward the outer surface 201 and the lower portion of the sidewall 206. The mounting clips 213 allow the canopy 7 to be hung onto a mounting plate 424. The canopy 7 further defines two mounting set screw holes 211 extending through the lower edge of the sidewall 206. Mounting set screw holes 211 threadably couple with mounting set screws 212 that are used to apply pressure against a mounting plate in order to cooperatively secure the canopy 7 to the mounting plate 424, for example as shown in FIG. 5A and as will be discussed in greater detail below.

Figure 3A:
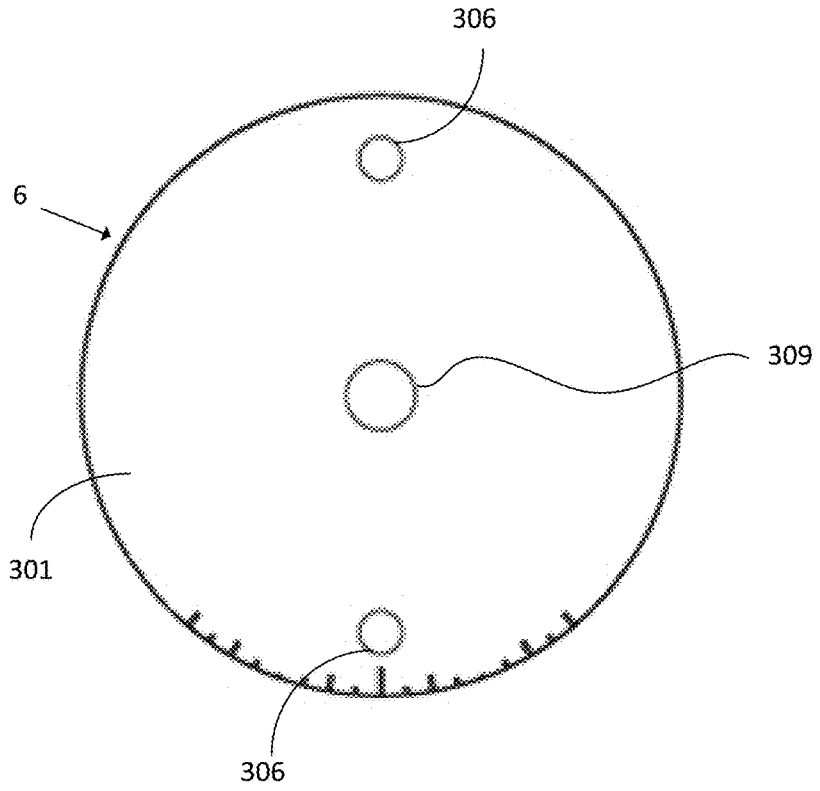
FIGS. 3A and 3B show views of a disk in accordance with embodiments of the disclosed technology.
Figure 3B:
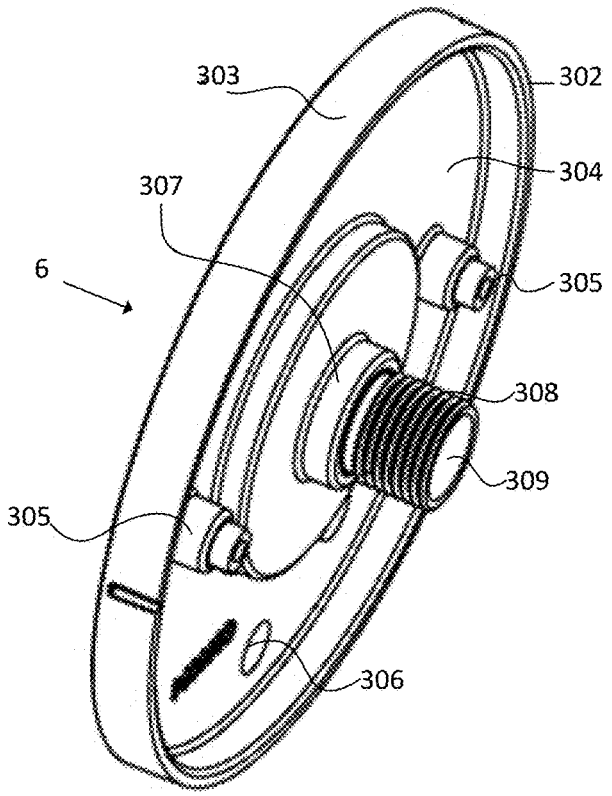

FIGS. 3A and 3B show an embodiment of a disk 6 as shown in FIG. 1A. As shown in FIG. 3A, the disk 6 includes an outer surface 301 and a sidewall 303 extending rearwardly from the outer surface 301 to a rear edge 302. The distance between the rear edge 302 and the outer surface 301 corresponds to the height of the recess sidewall 203 so that, when the disk 6 is positioned within the recess of the canopy 7, the outer surface 301 of the disk 6 and the outer surface 201 of the canopy 7 are substantially coplanar. The outer surface 301 and the outer surface 201 being coplanar has the aesthetic advantage of creating an appearance of a continuous smooth surface.

FIG. 3B shows the wall facing side of the disk 6. As shown in FIG. 3B, the disk 6 comprises an inner surface 304. Extending from inner surface 304 is an axle 307, which can be centered on the disk 6. Extending from the axle 307 is a threaded portion 308. The axle 307 is sized and shaped to be positioned and rotated within the center hole 204 of the canopy 7, wherein the center hole 204 supports the rotatable axle 307. The threaded portion 308 is sized the same size or smaller than the center hole 204 so that the threaded portion 308 can be passed through the center hole 204 in order to assemble disk 6 and canopy 7 in a rotatable coupling. The axle 307 and threaded portion 308 define a passage 309 for wiring to extend from the mounting wall through the disk 6, through the pivot arm assembly 3, and into the housing 2 for powering the light source(s).

The inner surface 304 further comprises two rotation limiting studs 305. The rotation limiting studs 305 are on opposite sides of the axle 307. The rotation limiting studs 305 are shaped and sized to be received within the rotation limiting tracks 205 of the canopy. The rotation limiting studs 305 may extend a distance from the inner surface 304 beyond that of the rear edge 302 so that when the rear edge 302 is directly adjacent the recess surface 202, the rotation limiting studs 305 can extend into the rotation limiting tracks 205. As shown, in embodiments the rotation limiting studs 305 are cylindrical, but could other geometrical shapes.

With the disk 6 positioned within the recess of the canopy 7, the rotation limiting studs 305 are received in the rotation limiting tracks 205 and the axle 307 is received within the center hole 204. Such engagement permits relative rotation between the disk 6 and canopy 7 about the second rotational axis 13. However, the engagement between the rotation limiting studs 305 and rotation limiting tracks 205 limits the rotational degree of freedom of the disk 6 and canopy 7. More specifically, the rotation limiting studs 305 contacting the ends of the rotation limiting tracks 205 prevents further rotation of the disk, thus defining the range of rotational motion of the second degree of freedom. The disk 6 further defines two mounting holes 306 extending between the outer surface 301 and inner surface 304. The mounting holes 306 receive fasteners to couple the pivot arm assembly 3 to the disk 6, as discussed further below.

Figure 4A:
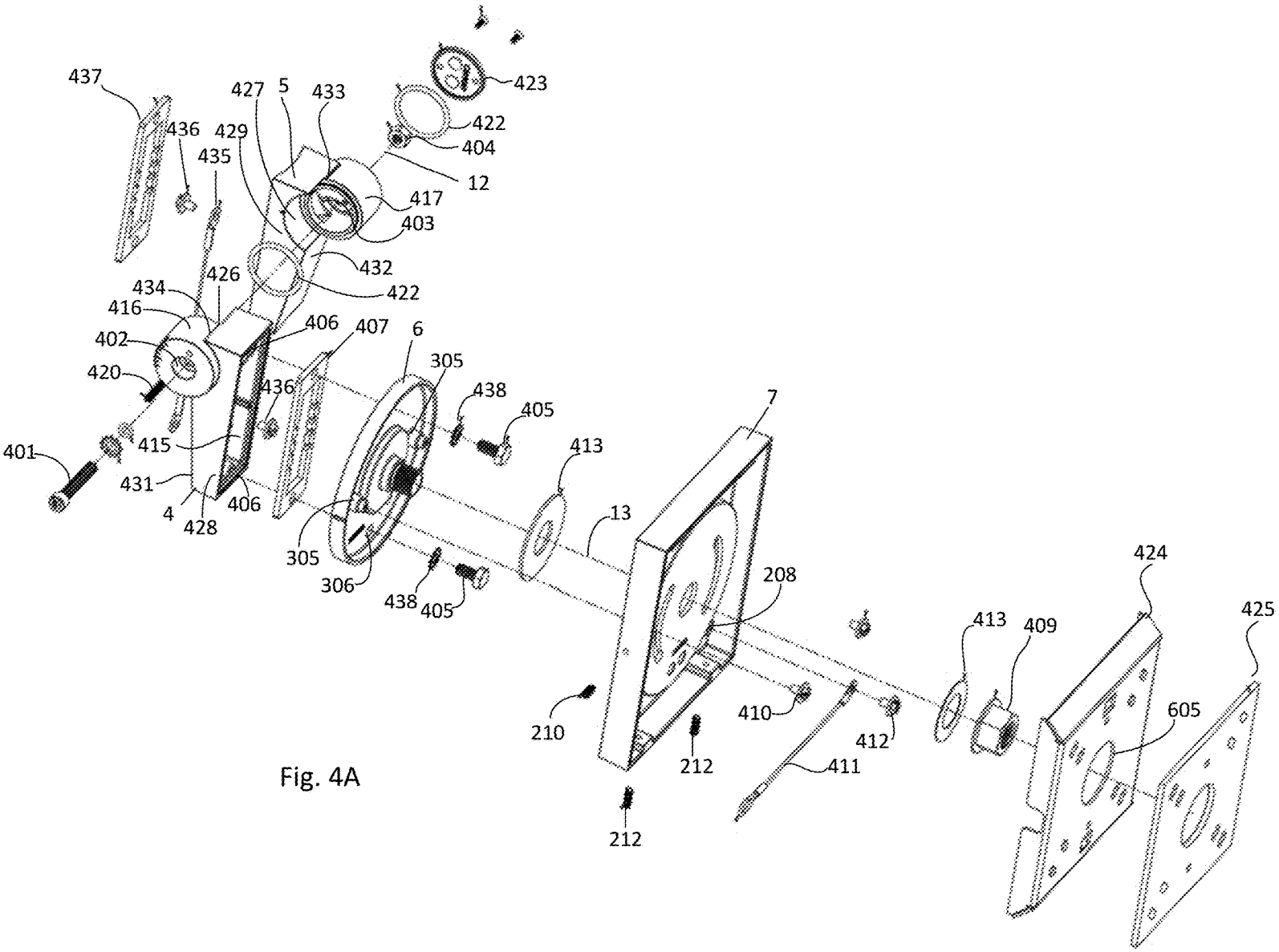
FIG. 4A shows an exploded view of an assembly of the mounting plate, canopy, disk and pivot arm assembly in accordance with embodiments of the disclosed technology.

FIG. 4A shows an exploded view of an assembly of the pivot arm assembly 3, disk 6, and canopy 7. The wall-side pivot arm 4 includes a body portion 428 having a sloped front wall face 431 and a circular portion 416. The body portion 428 and circular portion 416 may be integrally formed. The lighting side pivot arm 5 similarly has a body portion 429 having a sloped rear wall face 432 facing the sloped front wall face 431 of the wall-side pivot arm 4 (when assembled) and a circular portion 417. The body portion 429 and circular portion 417 may be integrally formed. While the body portions 428, 429 are shown as generally rectangular in cross-sectional shape, they could be other geometries. Moreover, while sloped walls 431, 432 are shown and described as being sloped, in embodiments the walls of the pivot arms could be parallel to relative to a plane orthogonal to the second rotational axis 13. The relative angle of the wall and the a plane orthogonal to the second rotational axis 13 may define the range of rotational motion between the wall-side pivot arm 4 and the lighting side pivot arm 5.

As shown, the wall-side pivot arm 4 is coupled to the lighting side pivot arm 5 with a fastener 401. The fastener 401 extends through an aperture 402 in the circular portion 416 of the wall-side pivot arm 4, and through an aperture 403 in the circular portion 417 of the lighting side pivot arm 5. In this way, the axis of the fastener 401 defines the first rotation axis 12. The wall-side pivot arm 4 defines an arc shaped recess 426 to receive a portion of circular portion 417 of the lighting side pivot arm 5, and the lighting side pivot arm 5 defines an arc shaped recess 427 to receive a portion of circular portion 416 of the wall-side pivot arm 4. The fastener 401 is secured with a nut 404. The tension of the fastener 401 and nut 404 may be adjusted to achieve a desired frictional force between the circular portions 416, 417 to allow the pivot arms 4, 5 to temporarily hold a set pivot angle between the pivot arms 4, 5. Further, as shown one of the pivot arms 4, 5 may include a set screw hole 421 to receive a set screw 420. Tightening the set screw 420 causes the set screw to embed into the opposing pivot arms 4, 5 to lock a set pivot angle between the two pivot arms 4, 5.

Figure 4B:
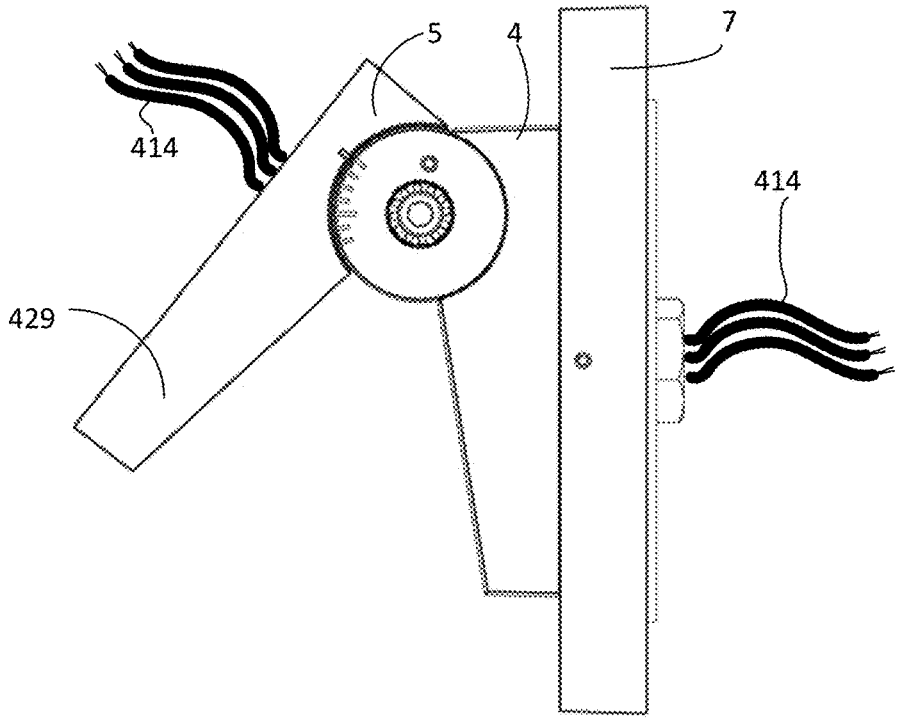
FIGS. 4B-4D show views of an assembly of the mounting plate, canopy, disk and pivot arm assembly in accordance with embodiments of the disclosed technology.

Threaded holes 406 may be provided on the rear side of body portion 428 (the side facing the wall when in situ). Threaded holes 406 receive fasteners 405 extending through washers 438 and mounting holes 306 of the disk 6 in order to fixedly couple the disk 6 to the pivot arm assembly 3. A gasket 407 may be positioned between the disk 6 and pivot arm assembly 3 to provide a snug connection and to prevent water and dirt from entering the cavity 415 of the wall-side pivot arm 4, where the wiring is located. A gasket 437 may be positioned between the housing 2 and pivot arm assembly 3 to provide a snug connection and to prevent water and dirt from entering the internal portion of the lighting side pivot arm 5, where the wiring is located. Further, a gasket 422 may be positioned between the circular portion 417 of lighting side pivot arm 5 and an end cap 423 in order to prevent water and dirt from entering the circular portions 416 and 417 where wiring 414 is also located. As shown in FIG. 4B, the wiring 414 extends from the wall side of the canopy 7, through the disk 6 and out the pivot arm assembly 3. To prevent the wall-side pivot arm 4 and lighting side pivot arm 5 from fully coming uncoupled when fastener 401 is not present, a safety cable 435 may have opposite ends secured to the wall-side pivot arm 4 and lighting side pivot arm 5 with fasteners 436. The safety cable 435 may extend through the circular portions 416 and 417 alongside the wiring 414.

The pivot arm assembly 3 defines a pivot rotation range between a first angle when the sloped front and rear wall faces 431, 432 of the respective body portions 428, 429 are in contact, and a second angle when the upper edges 433 and 434 of the rectangular body portions 428 and 429 proximate to the circular portions 416 and 417 abut, for example as shown in FIG. 1C.

With the pivot arm assembly 3 coupled to the disk 6, this assembly may be coupled to the canopy 7 by inserting the axle 307 of the disk 6 through the center hole 204 of the canopy 7 and securing a nut 409 on the threaded portion 308 of the axle 307. To provide smooth rotation of the disk 6 relative to the canopy 7 bearing washers 413 may be positioned between the inner surface 304 of the disk 6 and the recess surface 202 of the canopy 7 and between the nut 409 and the canopy 7. With the disk 6 positioned in the recess of the canopy 7, fasteners 410 are secured in threaded holes of the rotation limiting studs 305. The fasteners 410 include heads of greater dimension than the width of the rotation limiting tracks 205 in order to prevent the disk 6 from being pulled out of the recess of the canopy 7. Further, a safety cable 411 may be secured with a fastener 412 to the threaded stud 208 of the canopy 7. The safety cable 411 may be a braided metal cable or similar flexible chain, cable or rope.

A mounting plate 424 and wall gasket 425 may be positioned within the rear recess of the canopy 7 for packaging/shipping purposes, for example as shown in FIG. 5A. As will be discussed below in greater detail, during installation of the lighting fixture 1 the mounting plate 424 and wall gasket 425 are first separated from the assembly and mounted to a junction box prior to attaching the canopy 7 to the wall.

Figure 4C:
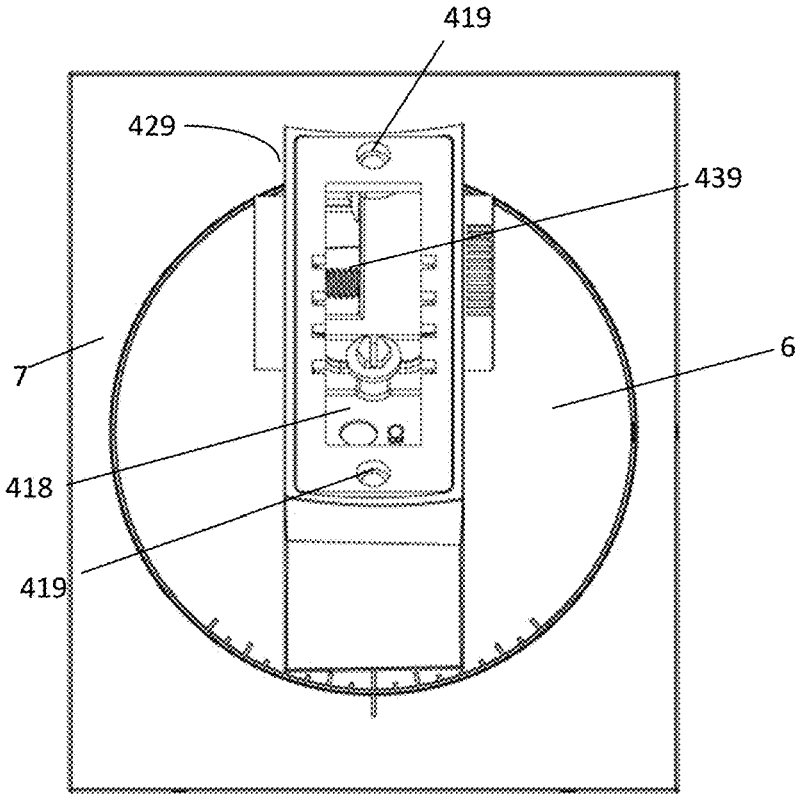
Figure 4D:
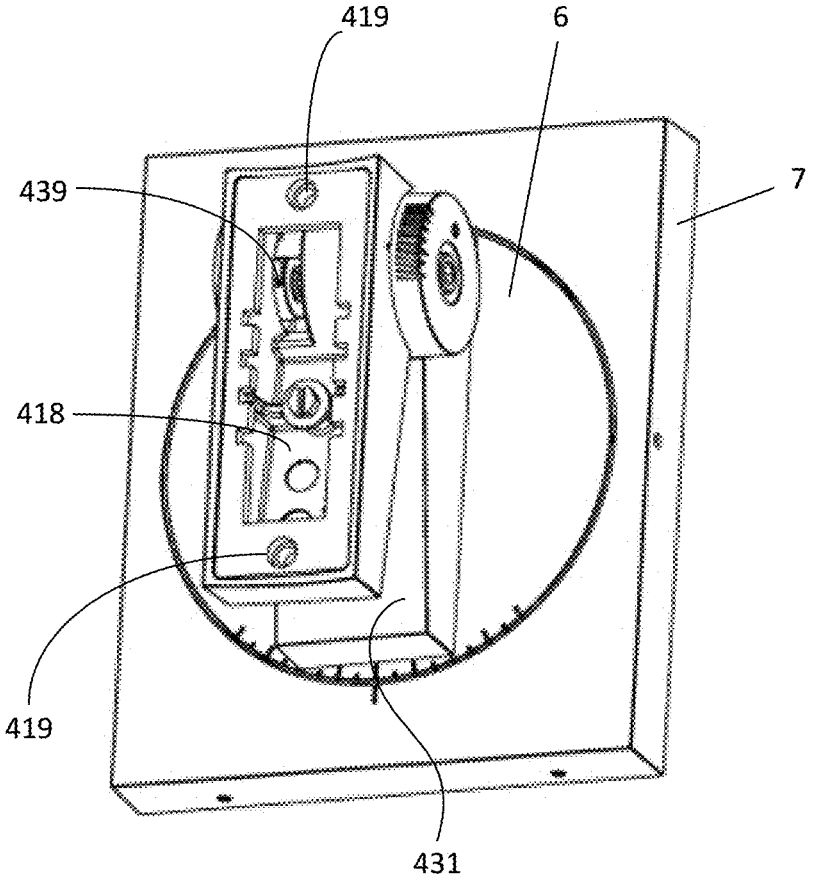

FIGS. 4B-4D show various views of an assembly of the pivot arm assembly 3, disk 6 and canopy 7. As shown, the wiring 414 extends into the canopy 7 and through the passage 309 of the threaded portion 308 of the axle 307. The wiring 414 is routed through the passage 309 on the lighting side of the disk 6 and into the cavity 415 of the wall-side pivot arm 4. The wiring 414 then extends through the cavity 415 of the wall-side pivot arm 4 through an aperture and into the internal portion of the circular portion 416 of the wall-side pivot arm 4. From the internal portion of the circular portion 416 of the wall-side pivot arm 4 the wiring 414 extends parallel to the first rotational axis 12 and into the circular portion 417 of the lighting side pivot arm 5. From the circular portion 417 of the lighting side pivot arm 5 the wiring 414 extends through an aperture 439 and into the cavity 418 on the front side of the body portion 429 of the lighting side pivot arm 5, as shown in FIG. 4C. This wiring path also for the wiring 414 to be sealed from the elements through the internal pathways in the disk 6 and pivot arms 4 and 5, and the gaskets 407, 422, and 437.

The front side of body portion 429 also includes a plurality of threaded holes 419 that receive fasteners to couple the housing 2 to the pivot arm assembly 3, as shown in FIG. 5A. To secure the housing 2 to the pivot arm assembly 3, fasteners are extended from inside of the housing 2 through holes 501 and into threaded holes 419 (see FIG. 5A). A gasket 437 as shown in FIG. 4A may be positioned between the body portion 429 of the light side pivot arm 5 and the housing 2.

Figure 6A:
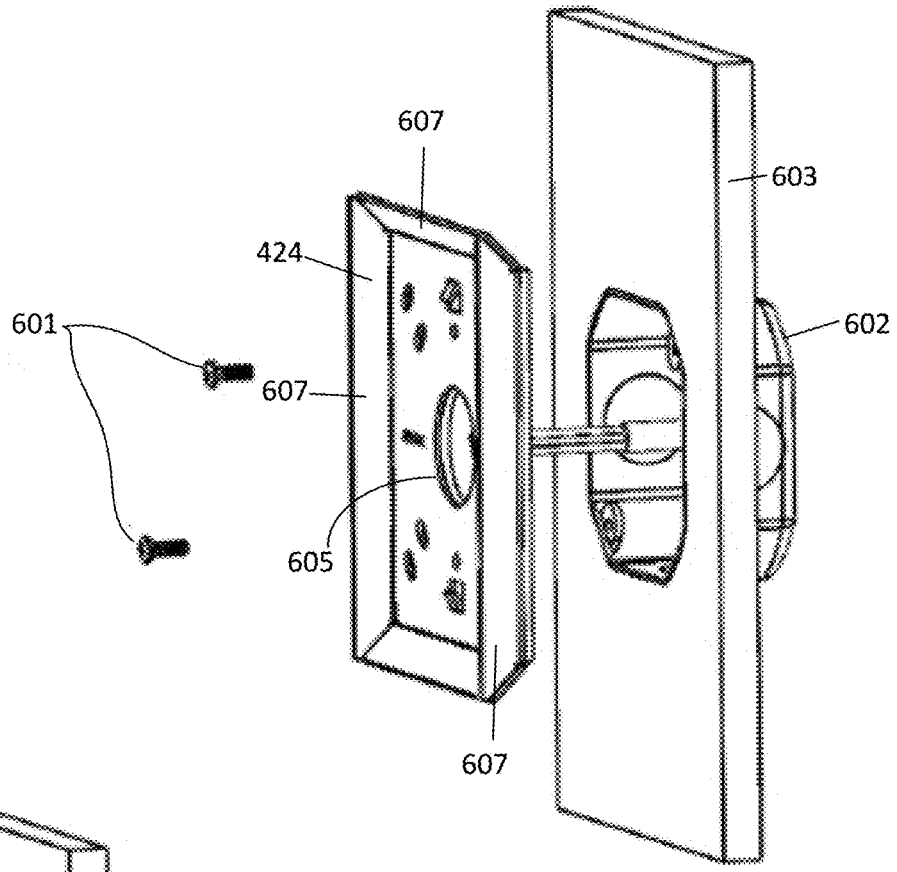
FIGS. 6A-6G show a method of installing a wall-mounted lighting fixture in accordance with embodiments of the disclosed technology.
Figure 6B:
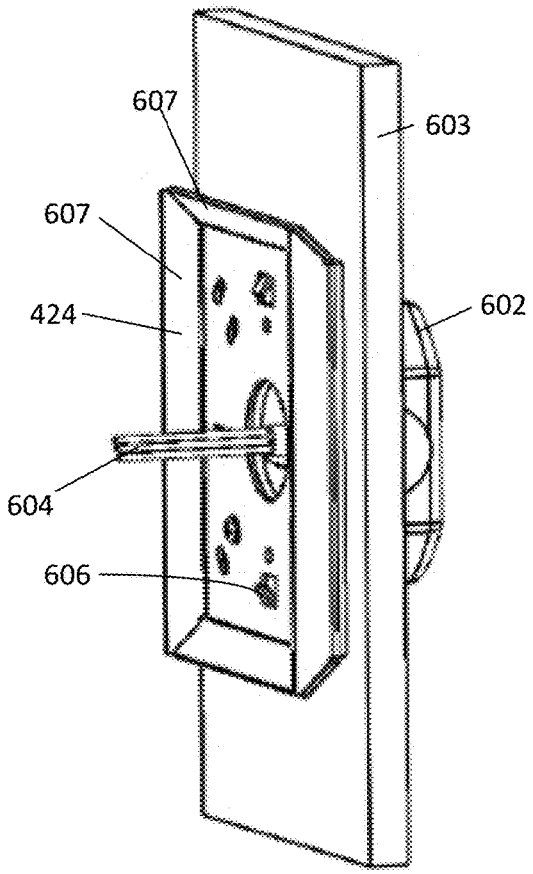
Figure 6C:
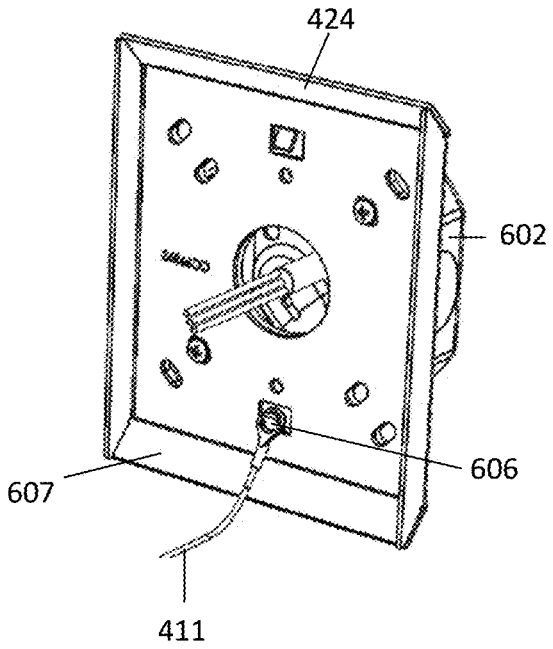
Figure 6D:
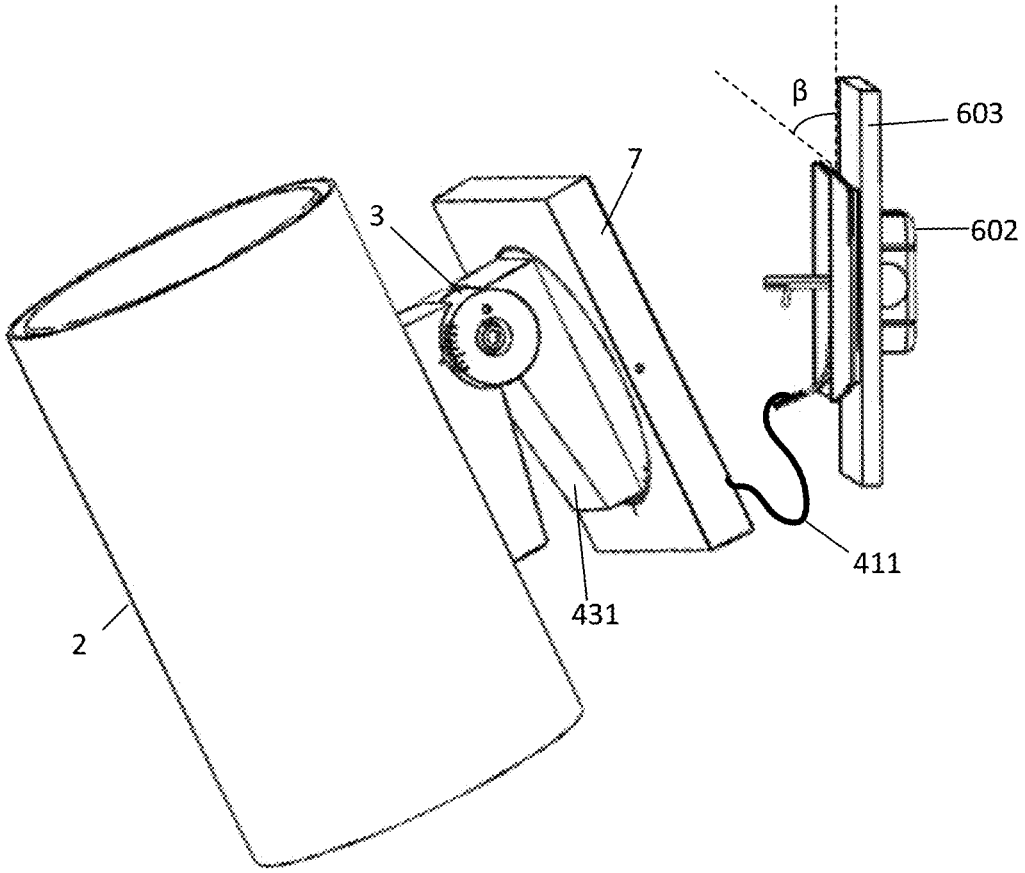

FIGS. 6A-6G show an embodiment of a method for installing a lighting fixture 1. The lighting fixture 1 may be mounted to a wall via a junction box 602. The junction box may be a surface mounted or a recessed junction box. As noted above, in the shipping configuration the mounting plate 424 may be positioned within the canopy 7. As shown in FIG. 6A, the mounting plate 424 may be rectangular and correspond in shape and size with the canopy 7. The mounting plate 424 may include beveled edges 607. To install the lighting fixture 1, the mounting plate 424 is removed from the canopy 7. To remove the mounting plate 424 the set screws 212 extending through the bottom of the canopy 7 may be loosened. With the mounting plate 424 removed, the mounting plate 424 is secured with screws 601 to a junction box 602 to directly contact a wall 603, as shown in FIGS. 6A and 6B. As shown, the power supply wires 604 from the junction box 602 extend through the central hole 605 in the mounting plate 424. Further as shown, the beveled edges 607 of the mounting plate 424 extend from the wall 603 at an angle θ relative to the mounting surface of the wall 603, as shown in FIG. 6D.

As shown in FIG. 6C, the safety cable 411 coupled to the canopy 7 of the lighting fixture may be placed over a hook 606 on the mounting plate 424, as shown in FIGS. 6C and 6D. The safety cable 411 prevents the lighting fixture 1 from falling to the ground and being damaged if the installer inadvertently drops the lighting fixture 1 during installation. Further, the safety cable 411 allows the lighting fixture 1 to hang while the power supply wires 604 are electrically connected to the wiring 414 of the lighting fixture 1. With the wires electrically connected, the excess wiring may be pushed through the central hole 605 of the mounting plate 424 and into the junction box 602.

Figure 6E:
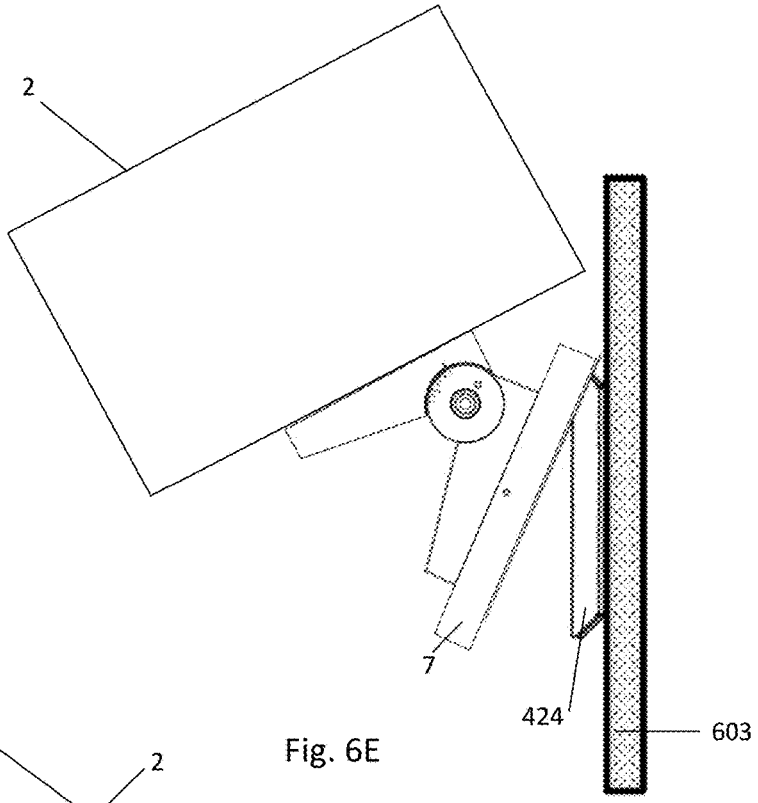
Figure 6F:
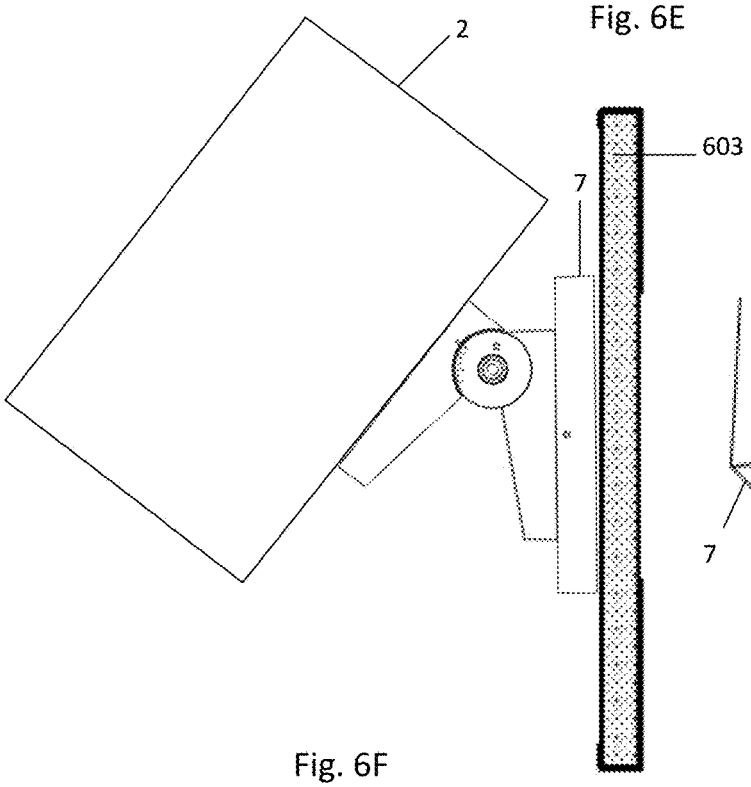
Figure 6G:
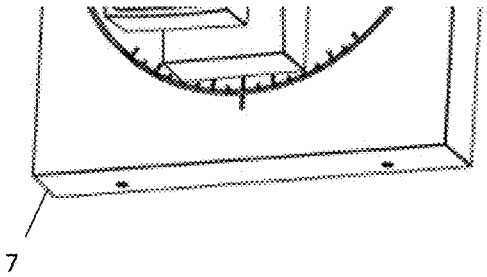

Next, the mounting clips 213 at the top edge of the canopy 7 are hung from the top beveled edge 607 of the mounting plate 424, as shown in FIG. 6E. As shown, the wall 603 is vertical. The angles of the beveled edge 607 and mounting clips 213 are selected in order to create a normal force that supports the lighting fixture 1 in the vertical direction and causes the lighting fixture 1 to be urged toward the wall 603. As shown in FIG. 6E, the top beveled edge 607 of the mounting plate 424 is angled upwardly from the wall 603, and the mounting clips 213 of the canopy 7 hang onto the top beveled edge 607. The canopy 7 may then be rotated downward so that the rear edge 209 of the canopy 7 is flush with the wall 603, as shown in FIG. 6F. The set screws 212 of the canopy 7 are then tightened to contact the lower beveled edge 607 of the mounting plate 424. The lower beveled edge 607 of the mounting plate 424 extends downwardly from the wall 603. Tightening the set screws 212 to the mounting plate 424 causes the canopy 7 to be pulled toward the wall 603 so that the canopy 7 contacts and makes a tight flush fit against the wall 603. Caulk may be used around the interface of the canopy 7 and wall 603 for a waterproof coupling and/or to address inconsistent wall surfaces.

Figure 7A:
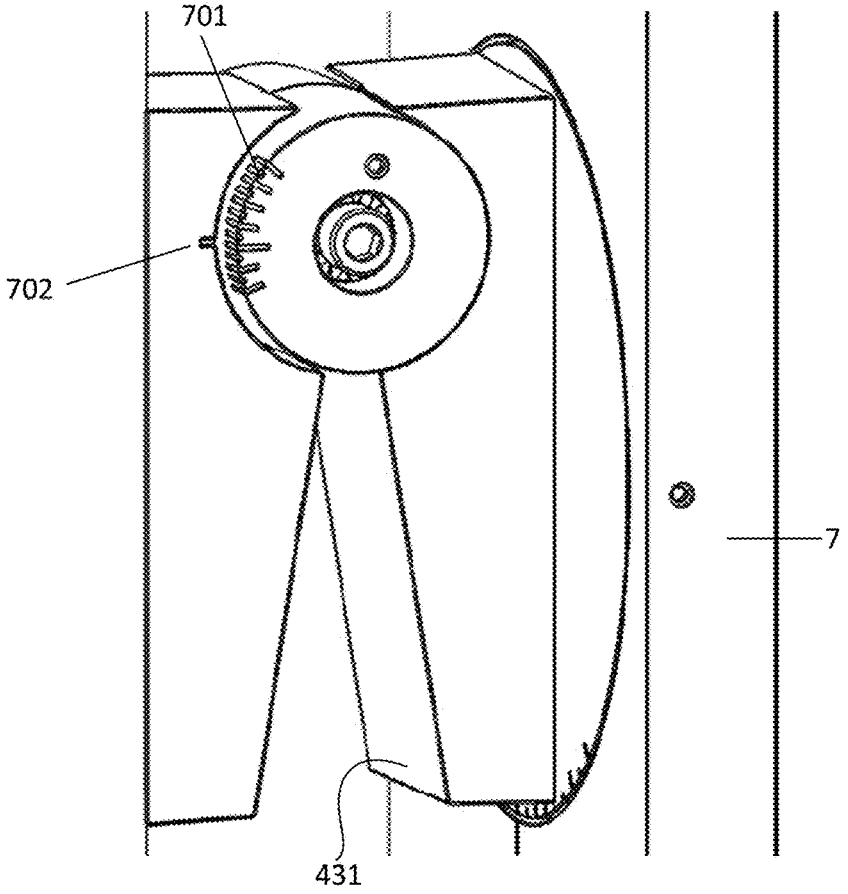
FIGS. 7A and 7B show views of an aiming assembly in accordance with embodiments of the disclosed technology.

The orientation of the housing 2 may be set before or after mounting the lighting fixture 1 to the wall 603. For example, with the lighting fixture 1 secured to the wall 603, the direction of the light emitted from the housing 2 may be aimed using both the rotatable coupling of the disk 6 and canopy 7, and the tilt adjustment of the pivot arm assembly 3. As shown in FIG. 7A, the pivot arm assembly 3 may include angle indicators that assist the installer in setting the housing 2 to the desired tilt angle. For example, angle markings 701 may be provided on the circular portion 416, 417 of one of the wall-side pivot arm 4 or lighting side pivot arm 5 with an indexing mark 702 provided on the other of the wall-side pivot arm 4 or lighting side pivot arm 5. Alignment of the indexing mark 702 with the desired angle as reflected by the angle markings 701 ensure the desired tilt angle is set. An installer may adjust the tilt angle to a predetermined angle or may visually set the angle based on the directionality of the emitted light. The tension of fastener 401 is set so that friction in the pivot arm assembly 3 can temporarily hold the housing 2 at the desired tilt angle while the set screw 420 is tightened to lock the tilt angle.

Figure 7B:
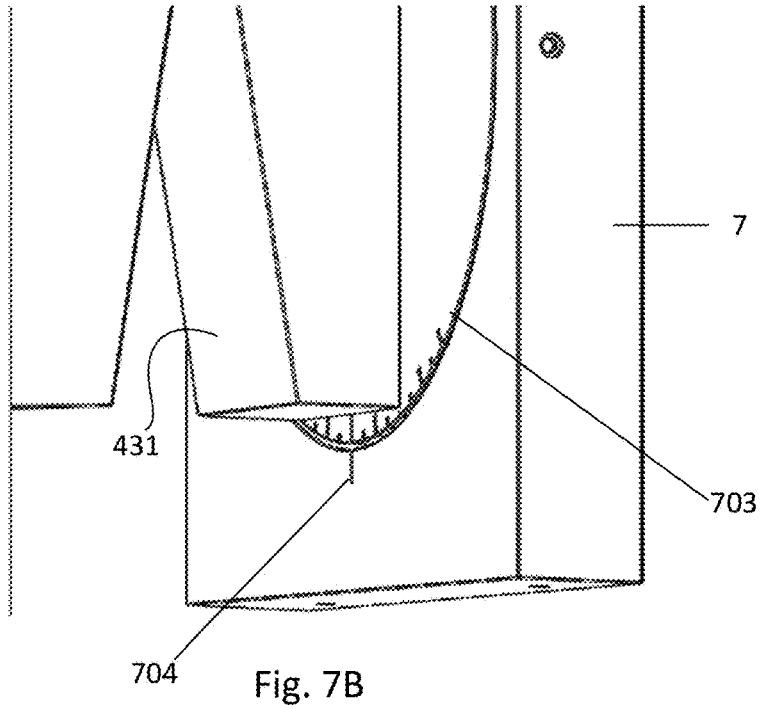

A shown in FIG. 7B, to assist the installer in setting the rotation angle, a plurality of angle marks 703 may be provided on one of the disk 6 or canopy 7 and an indexing mark 704 provided on the other of the disk 6 or canopy 7. An installer may adjust the rotation angle to a predetermined angle or may visually set the angle based on the directionality of the emitted light. Prior to attaching the canopy 7 to the mounting plate 424 secured to the wall, the tension of nut 409 may be set so that friction in the disk and canopy assembly can temporarily hold the housing 2 at in the desired rotational angle while adjusting the rotational angle of the disk 6 relative to the canopy 7 prior to the set screw 210 being tightened to lock the rotational angle. Sets screws 210 and 420 may be loosened and re-tightened into any portion of the corresponding surface of the disk or a pivot arm in order to re-adjust the tilt and/or rotational angle to different angles.

Figure 8A:
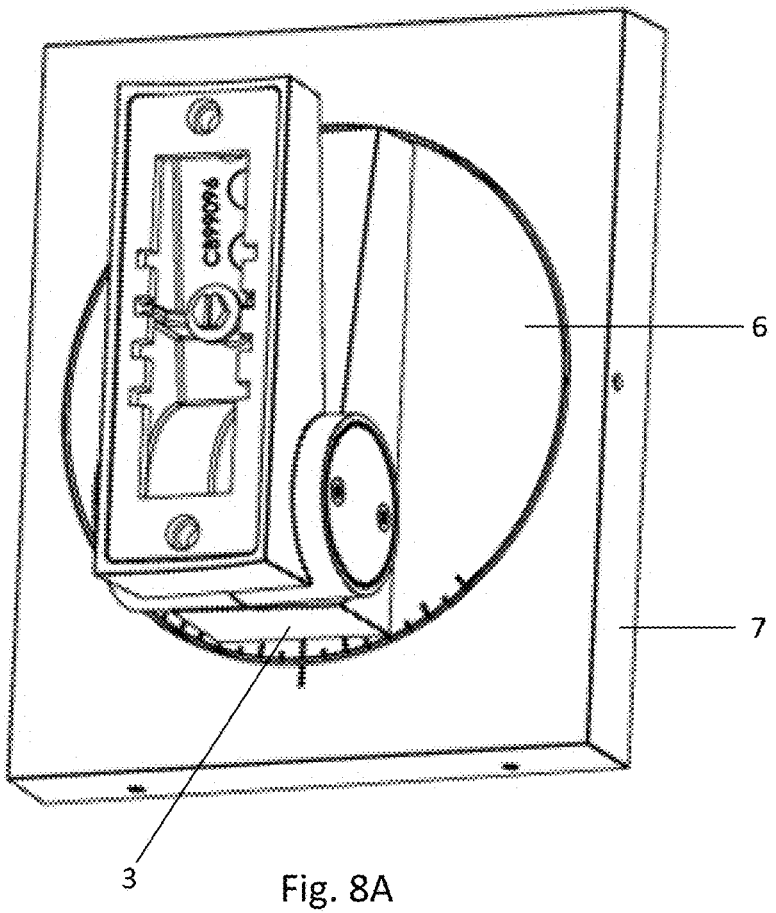
FIGS. 8A and 8B show views of a wall-mounted lighting fixture in an up-light configuration in accordance with embodiments of the disclosed technology.
Figure 8B:
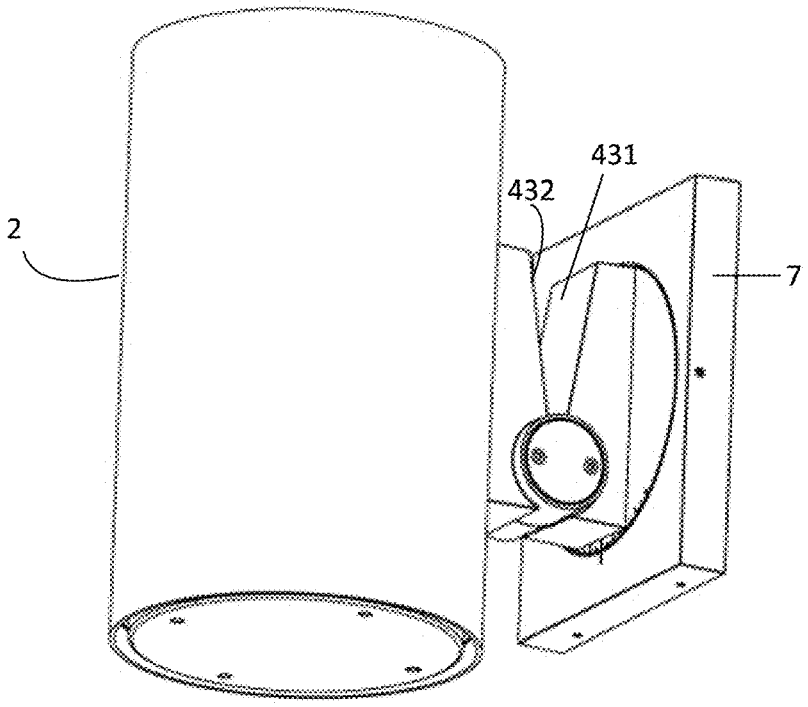

Embodiments of lighting fixtures, for example as shown in FIG. 1A, show a downlight lighting fixture, in that in the installed configuration the rotational angle is set so that the emitted light is generally downwardly pointing. However, in other embodiments, the lighting fixture may be assembled as an uplight so that in the installed configuration the rotational angle is set so that the emitted light is generally upwardly pointing. For example, FIGS. 8A and 8B illustrate an embodiment of a lighting fixture 1 whereby the pivot arm assembly 3 is coupled to the disk 6 at a 90° offset from that shown in FIG. 1A so that the hinge is toward the lower end of the disk 6. With the pivot assembly and disk coupled as shown in FIG. 8A, the housing 2 may be attached to the pivot arm assembly 3 so that emitted light is directed upwardly, as shown for example in FIG. 8B.

The various aspects, embodiments, implementations or features of the described embodiments can be used separately or in any combination. In particular, it should be appreciated that the various elements of concepts from FIGS. 1A-8B may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A lighting fixture comprising:

a canopy configured to be mounted against a vertical wall, wherein the canopy defines a cylindrical recess recessed from an outer surface of the canopy;

a housing configured to contain a light emitting element, wherein the housing is configured to emit light from the light emitting element out of an aperture of the housing; and an aiming assembly coupled to the housing and to the canopy, wherein the aiming assembly comprises circular disk positioned within the cylindrical recess, wherein the circular disk is rotatably coupled to the canopy in order to rotate within the cylindrical recess, wherein the circular disk comprises an outer surface coplanar with the outer surface of the canopy, and wherein the aiming assembly is configured to allow for adjustment of a direction of the light emitted from the housing in at least two rotational degrees of freedom relative to the canopy.

2. The lighting fixture of claim 1, wherein one of the at least two rotational degrees of freedom is a tilting degree of freedom with an axis of rotation that is horizontal and parallel to the vertical wall.

3. The lighting fixture of claim 2, wherein the aiming assembly comprises a pivot arm assembly configured to allow for the tilting degree of freedom, wherein the pivot arm assembly comprises a first pivot arm coupled to the housing, and a second pivot arm coupled to the outer surface of the circular disk, wherein the first pivot arm is rotationally coupled to the second pivot arm to define a hinge allowing for the tilting degree of freedom, and wherein wiring extends through the canopy, through the circular disk, through the first pivot arm, through the second pivot arm, and into the housing to provide electricity to the lighting element.

4. The lighting fixture of claim 1, wherein one of the at least two rotational degrees of freedom is a rotating degree of freedom with an axis of rotation that is horizontal and perpendicular to the vertical wall.

5. A lighting fixture comprising:

a canopy configured to be mounted against a vertical wall;

a housing configured to contain a light emitting element, wherein the housing is configured to emit light from the light emitting element out of an aperture of the housing; and an aiming assembly coupled to the housing and to the canopy, wherein the aiming assembly is configured to allow for adjustment of a direction of the light emitted from the housing in at least two rotational degrees of freedom relative to the canopy, wherein one of the at least two rotational degrees of freedom is a rotating degree of freedom with an axis of rotation that is horizontal and perpendicular to the vertical wall, wherein the aiming assembly comprises a disk rotationally coupled to the canopy and configured to allow for the rotating degree of freedom, wherein the disk is circular and the canopy defines a circular recess, wherein the disk is positioned within the circular recess, wherein the circular recess defines a central hole and at least one arc shaped rotational limiting track, wherein the disk comprises an axle extending through the central hole and configured to allow the disk to rotate relative to the canopy, wherein the disk further comprises at least one rotation limiting stud positioned within the at least one arc shaped rotational limiting track, and wherein the arc shaped rotational limiting track and the rotation limiting stud define a range of the rotating degree of freedom.

6. The lighting fixture of claim 5, wherein the at least one arc shaped rotational limiting track comprises two arc shaped rotational limiting tracks and the at least one rotation limiting stud comprises two rotation limiting stud, and wherein a first rotation limiting stud of the two rotation limiting studs is positioned within a first rotational limiting track of the two rotational limiting tracks and a second rotation limiting stud of the two rotation limiting studs is positioned within a second rotational limiting track of the two rotational limiting tracks.

7. The lighting fixture of claim 5, wherein the arc shaped rotation limiting track defines an arc length between 50 degrees and 170 degrees in order to define the range of the rotating degree of freedom between 50 degrees and 170 degrees.

8. The lighting fixture of claim 7, wherein a second of the at least two rotational degrees of freedom is a tilting degree of freedom with an axis of rotation that is horizontal and parallel to the vertical wall, wherein the aiming assembly further comprises a pivot arm assembly configured to allow for the tilting degree of freedom, wherein the pivot arm assembly comprises a first pivot arm coupled to the housing, and a second pivot arm coupled to the disk;

wherein the first pivot arm is rotationally coupled to the second pivot arm to define a hinge allowing for the tilting degree of freedom, and wherein wiring extends through the central hole, through the axle of the disk, through the first pivot arm, through the second pivot arm, and into the housing to provide electricity to the lighting element.

9. The lighting fixture of claim 8, wherein the canopy defines a first set screw hole threadably coupled to a first set screw, wherein the first set screw is configured to contact the disk in order to secure the disk at a set angle in the rotating degree of freedom.

10. The lighting fixture of claim 9, wherein the canopy defines a first indexing mark and the disk defines first angle markings, wherein the first indexing mark and the first angle markings are configured to allow an installer to set the set angle of the rotating degree of freedom.

11. The lighting fixture of claim 10, wherein one of the first pivot arm of the second pivot arm defines a second set screw hole threadably coupled to a second set screw, wherein the second set screw is configured to contact the pivot arm that the set screw is not threadably coupled to in order to secure the pivot arm assembly at a set angle in the tilting degree of freedom.

12. The lighting fixture of claim 11, wherein one of the first pivot arm and the second pivot arm define a second indexing mark and the other of the first pivot arm and the second pivot arm defines second angle markings, wherein the second indexing mark and the second angle markings are configured to allow an installer to set the set angle of the tilting degree of freedom.

13. A method of aiming the lighting fixture of claim 12, comprising:

rotating the disk relative to the canopy using the first index mark and the first angle marking to the set angle of the rotating degree of freedom; and tightening the first set screw into the disk to secure the set angle of the rotating degree of freedom.

14. The method of claim 13, further comprising:

tilting the first pivot arm relative to the second pivot arm using the second index mark and the second angle marking to the set angle of the tilting degree of freedom; and tightening the second set screw into the first pivot arm or the second pivot arm to secure the set angle of the tilting degree of freedom.

15. The lighting fixture of claim 8, wherein the pivot arm assembly is configured to be coupled to the disk in a first configuration wherein the light emitting element emits light in a generally downward direction relative to the vertical wall and coupled to the disk in a second configuration wherein the light emitting element emits light in a generally upward direction relative to the vertical wall.

16. The lighting fixture of claim 8, further comprising a mounting plate, wherein the mounting plate is configured to be coupled to a junction box in the vertical wall, and wherein the mounting plate is received in a recess defined on a wall side of the canopy.

17. The lighting fixture of claim 16, wherein the mounting plate defines a top beveled edge and a bottom beveled edge, wherein the recess comprise a mounting clip configured to hang on the top beveled edge of the mounting plate, and wherein the canopy define a mounting set screw hole configured to receive a mounting set screw to contact the bottom beveled edge of the mounting plate in order to secure the canopy to the mounting plate so that the lighting fixture is secured to the wall.

18. The lighting fixture of claim 17, further comprising a safety cable, wherein the safety cable is coupled to the mounting plate and the recess of the canopy.

19. A method of mounting the lighting fixture of claim 18 to the vertical wall, comprising:

coupling the mounting plate to the junction box;

extending wall side wiring from the junction box through the mounting plate;

coupling the safety cable coupled to the canopy to a hook on the mounting plate;

electrically connecting the wiring to the wall side wiring with the canopy hanging from the mounting plate by the safety cable;

hanging the canopy on the mounting plate with the mounting clip; and securing the canopy to the mounting plate with the mounting set screw.

* * * * *